US005694477A

United States Patent [19]

Kole

[11] Patent Number: 5,694,477

[45] Date of Patent: Dec. 2, 1997

[54] PHOTOTHERMAL ACOUSTIC DEVICE

[76] Inventor: Stephen G. Kole, 2 Hudson St., Port Jervis, N.Y. 12771

[21] Appl. No.: 569,852

[22] Filed: Dec. 8, 1995

[51] Int. Cl.[6] ..... H04R 3/00

[52] U.S. Cl. ..... 381/111; 381/71; 359/150

[58] Field of Search ..... 381/111–114, 122, 381/164, 71, 95, 96, 108; 359/149, 150, 246, 276, 286, 288, 289, 245; 372/26–28

[56] References Cited

U.S. PATENT DOCUMENTS

| | | | |
|---|---|---|---|
| 3,581,230 | 5/1971 | Smith | 372/26 |
| 3,982,817 | 9/1976 | Feichtner | 359/287 |
| 4,008,966 | 2/1977 | Frank et al. | 359/305 |
| 4,641,377 | 2/1987 | Rush et al. | 381/111 |

*Primary Examiner*—Curtis Kuntz
*Assistant Examiner*—Ping W. Lee
*Attorney, Agent, or Firm*—Darby & Darby

[57] ABSTRACT

A photothermal apparatus is provided for controllably heating and cooling a gas in order to alter and thereby control the acoustic, mechanical or optical properties of the gas. For acoustic applications, the photothermal device may be used to heat and cool the gas in order to generate three-dimensional spatially-located sound corresponding to an electrical audio signal. Also, the photothermal device may be used to generate a three-dimensional sound shield around a noise source in order to prevent the propagation of sound waves from the noise source. It may also be used to controllably heat and cool a gas to thereby provide mechanical energy or force for moving an object.

8 Claims, 8 Drawing Sheets

FUNCTION GENERATOR
252
X-AXIS
Y-AXIS
Z-AXIS
258
TUNER
Z-AXIS
Y-AXIS
X-AXIS
256
VCR
Z-AXIS
Y-AXIS
X-AXIS
254
PHONO
Z-AXIS
Y-AXIS
X-AXIS
PRE-AMPLIFIER/ MIXER
244
Z-AXIS
Y-AXIS
X-AXIS
CONTROL
242
Z-AXIS
Y-AXIS
X-AXIS
(RF) RADIO FREQUENCY GENERATOR
250
X-AXIS
Z-AXIS
Y-AXIS
A
A
200

◂Run▸ Comp Temp WN/WL Range Mol LineShp PatLen Press File Scr Quit
Slant Path/ Layer Model
Laser Line Overlay
Graph Cursor
Show Current Parameters
Load Param From CFG Type File

| Molec | Sel | P(atm) | | | | | | |
|---|---|---|---|---|---|---|---|---|
| HN03 | --- | 5.00E-11 | H2O | --- | 7.75E-03 | NO | --- | 3.00E-10 |
| 03 | | 2.66E-08 | C10 | --- | 1.00E-14 | NH3 | --- | 5.00E-11 |
| NO2 | --- | 2.30E-11 | H2CO | --- | 2.40E-09 | HI | --- | 3.00E-12 |
| SO2 | --- | 3.00E-10 | N2O | --- | 3.20E-07 | HBr | --- | 1.70E-12 |
| HOC1 | --- | 7.70E-12 | CH4 | --- | 1.70E-06 | HC1 | --- | 1.00E-09 |
| H2O2 | --- | 2.00E-10 | O2 | --- | 2.09E-01 | | | |
| OCS | --- | 6.00E-10 | CO | --- | 1.50E-07 | | | |
| | | | HCN | --- | 1.70E-10 | | | |

Path = 2.00m Inor = 1.79E-02cm-1 Temp = 296.00K Total P(atm) = 1.00E+00

FIG. 5

◂Run▸ Comp Temp WN/WL Range Mol LineShp PatLen Press File Scr Quit
Slant Path/ Layer Model
Laser Line Overlay
Graph Cursor
Show Current Parameters
Load Param From CFG Type File

| Moleo | Sel | P(atm) | | | | | | | |
|---|---|---|---|---|---|---|---|---|---|
| 203 | | 2.66E-08 | H20 | --- | 7.75E-03 | OH | --- | 4.40E-14 | |
| 9PH3 | --- | 1.00E-20 | H202 | --- | 2.00E-10 | HCN | --- | 1.70E-10 | |
| 9CH4 | --- | 1.70E-06 | H2S | --- | 1.00E-20 | O2 | --- | 2.09E-01 | |
| 0CO2 | --- | 3.30E-04 | SO2 | | 3.00E-10 | NO | --- | 3.00E-10 | |
| 9NO2 | --- | 2.30E-11 | HN03 | --- | 5.00E-11 | CO | --- | 1.50E-07 | |
| 4NH3 | --- | 5.00E-11 | HOC1 | --- | 7.70E-12 | HI | --- | 3.00E-12 | |
| N2O | --- | 3.20E-07 | C2H2 | | 3.00E-10 | N2 | --- | 7.81E-01 | |
| | | | COF2 | | 1.00E-20 | OCS | --- | 6.00E-10 | |

| Laser Line Data | | |
|---|---|---|
| | | -1 |
| | | -0 |
| 2XCO2.LSR | --- | -0 |
| CO2.LSR | --- | -1 |
| ERYAG.LSR | --- | -0 |
| HENE.LSR | --- | -1 |
| HOYAG.LSR | --- | |
| HOYLF.LSR | --- | |
| HOYSGG.LSR | | |
| TMYAG.LSR | | |

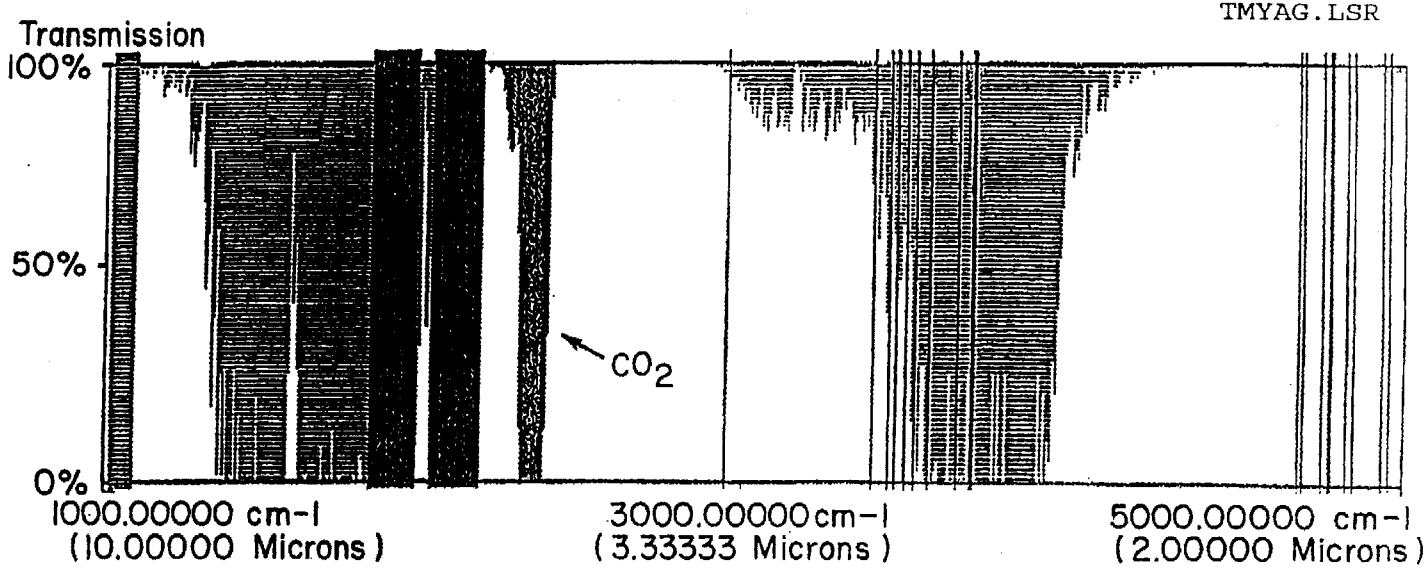

Path = 2.00m Incr = 7.14+00cm-1 Temp = 296.00K Total P(atm) = 1.00E+00

◂Run▸ Comp Temp WN/WL Range Mol LineShp PatLen Press File Scr Quit
Slant Path/ Layer Model
Laser Line Overlay
Graph Cursor
Show Current Parameters
Load Param From CFG Type File

| Moleo | Sel | P(atm) | OH | --- | 4.40E-14 |
|---|---|---|---|---|---|
| O3 | | 2.66E-08 | N2 | --- | 7.81E-01 |
| NO | --- | 3.00E-10 | HI | --- | 3.00E-12 |
| H2O | --- | 7.75E-03 | CH4 | --- | 1.70E-06 |
| CO | --- | 1.50E-07 | OCS | --- | 6.00E-10 |
| NH3 | --- | 5.00E-11 | HBr | --- | 1.70E-12 |
| CO2 | --- | 3.30E-04 | HCl | --- | 1.00E-09 |
| N2O | --- | 3.20E-07 | SO2 | | 3.00E-10 |

Path = 2.00m Incr = 8.93E-01cm-1 Temp = 296.00K Total P(atm) = 1.00E+00

PHOTOTHERMAL ACOUSTIC DEVICE

FIELD OF THE INVENTION

The present invention generally relates to photothermal devices. More specifically, the present invention relates to photothermal devices which controllably heat and cool a gas to thereby control the pressure and density of the gas so as to produce acoustic or mechanical pressure.

BACKGROUND OF THE INVENTION

Devices which controllably produce acoustic or mechanical pressure are well known. Acoustic devices, such as loudspeakers, convert electrical energy into mechanical energy. An electrical energy signal is typically applied to the magnetic coil and diaphragm assembly of the speaker which causes the diaphragm to vibrate and thereby generate acoustic or sound waves in response to the electrical signal. One disadvantage of this conventional approach is that the sound is generated from a single point source, i.e., the speaker itself. This type of sound often does not sound as realistic as sound generated at different locations in space.

An alternative acoustic device is known, wherein a laser beam is used to convert an electrical signal into sound. Such a device is disclosed in U.S. Pat. No. 4,641,377 to Rush et al., the contents of which are incorporated by reference herein. The device disclosed in the Rush et al. patent is a photoacoustic speaker which produces photoacoustic sound by modulating the intensity of the laser beam in accordance with an electrical input signal. The modulated laser beam output is passed into an enclosed gas absorption chamber containing gas which absorbs the laser beam signal. The gas is heated as it absorbs photons of the laser output wavelength and produces photothermic pressure waves corresponding to the electrical input signal. Because the intensity of the laser beam varies according to the electrical input signal, the heating of the gas is not uniform, but rather, varies with the intensity of the electrical input signal. The absorbing gas is thus heated proportionately according to the electrical input signal. The heating and subsequent cooling of the absorbing gas produce pressure waves which propagate radially outwardly. The photothermic pressure waves produce sound when they impinge on the walls of the enclosed chamber.

Rush et al. indicate that the enclosed chamber may be a room and that the absorbing gas may be air. However, it should be noted that according to the Rush et al. patent, the disclosed device only produces sound exterior to the enclosed chamber and this is a result of the vibration of the chamber walls. Essentially, the Rush et al. device operates along the same lines as a conventional speaker, using the chamber walls as the vibrating diaphragm in order to produce sound pressure waves external to the enclosed chamber. In this manner, the Rush et al. device is capable of producing only a column of sound emanating from the diaphragm, i.e., the chamber wall.

Also known are mechanical or electromechanical devices which control the position and movement of objects in an air environment. One class of such devices is magnetic levitation devices in which an object is suspended in air or propelled along a predetermined course. These devices typically utilize magnets or electromagnets to create a repulsive force which is used to counteract the gravitational force and/or to provide a propulsion force.

Also known are acoustic devices which operate to process sound, such as for example, noise cancellation or reduction devices. Automobiles or other machinery often generate excessive amounts of noise which are either unpleasant or exceed proscribed noise levels as mandated by governmental or safety regulations. One approach to reducing or eliminating the noise source is to generate an equal but opposite noise source, i.e., one which is equal in magnitude but opposite in phase, i.e., 180° out of phase. Ideally, the acoustic waves from the original noise source and the generated noise source combine to cancel each other. Practically however, total noise elimination cannot be achieved, since there is some delay in generating the out of phase noise source because it is often generated as a continuous sample based on the original noise source. Thus,the generated noise source is not truly 180° out of phase. This is not the case, however, where the original noise source may be modeled a priori, thus allowing for the real-time generation of a 180° phase shifted noise source.

SUMMARY OF THE INVENTION

According to the present invention, a novel apparatus is provided for controllably heating and cooling a gas. This type of apparatus, also known as a photothermal device, may be used to heat and cool a gas in order to alter and thereby control the acoustic, mechanical or optical properties of the gas itself or objects under the influence of the gas. For acoustic applications, the photothermal device may be used to generate three-dimensional spatially-located sound corresponding to an electrical audio signal. Also, the photothermal device may be used to generate a three-dimensional sound shield around a noise source in order to prevent the propagation of sound waves from the noise source.

The present invention operates on the principle that when a gas is heated, it gains energy and expands. Conversely, when the heat is removed, it loses energy and contracts. A laser source is used to provide infrared or other frequency light energy to the gas at the location to which it is directed, causing the gas to heat at that location and expand, thereby converting the laser energy into acoustical or mechanical energy. In this manner, sound may be generated along the length of the laser beam by modulating or turning on/off the output of the laser beam in accordance with the frequency characteristics of a desired audio signal. If two or more lower power laser beams are made to intersect at a point in space so that their combined heating effects are sufficient to heat the location in space, multi-dimensional spatially-located sound may be generated. In a preferred embodiment, three lasers forming a tri-axial laser energy source "deposit" energy at specific points in three-dimensional space creating acoustic sources at those points. The present invention may also be used to provide a three-dimensional acoustic barrier using a tri-axial laser energy source to produce a holographic or pseudo-holographic effect for the production and/or cancellation of sound in a controlled, specified manner.

The present invention may also be used to controllably heat and cool a gas to thereby provide mechanical energy or force. In one embodiment according to the present invention, the controlled heating and cooling of the gas may be used to establish standing waves. These standing waves are static and stationary, in that despite ongoing propagation of sound, there exists in a given space close to the source, molecular pressure zones created by the regular peaks and valleys of the standing wave. The standing waves may thus be used as sound barriers or even physical barriers. In the case of physical barrier, the standing wave is created with sufficient energy to counteract the opposing mechanical force. In this manner, photothermoacoustic levitation may be achieved. Similarly, if the standing wave is created with sufficient energy greater than the opposing mechanical force, then photothermoacoustic propulsion or motion may be achieved.

BRIEF DESCRIPTION OF THE DRAWINGS

Other objects, features and advantages of the invention discussed in the above brief explanation will be more clearly understood when taken together with the following detailed description of an embodiment which will be understood as being illustrative only, and the accompanying drawings reflecting aspects of that embodiment, in which:

FIG. 5 is a transmission graph showing energy transmission efficiency in the range of 10 to 2 microns;

DETAILED DESCRIPTION OF THE PREFERRED EMBODIMENTS

Figure 1:
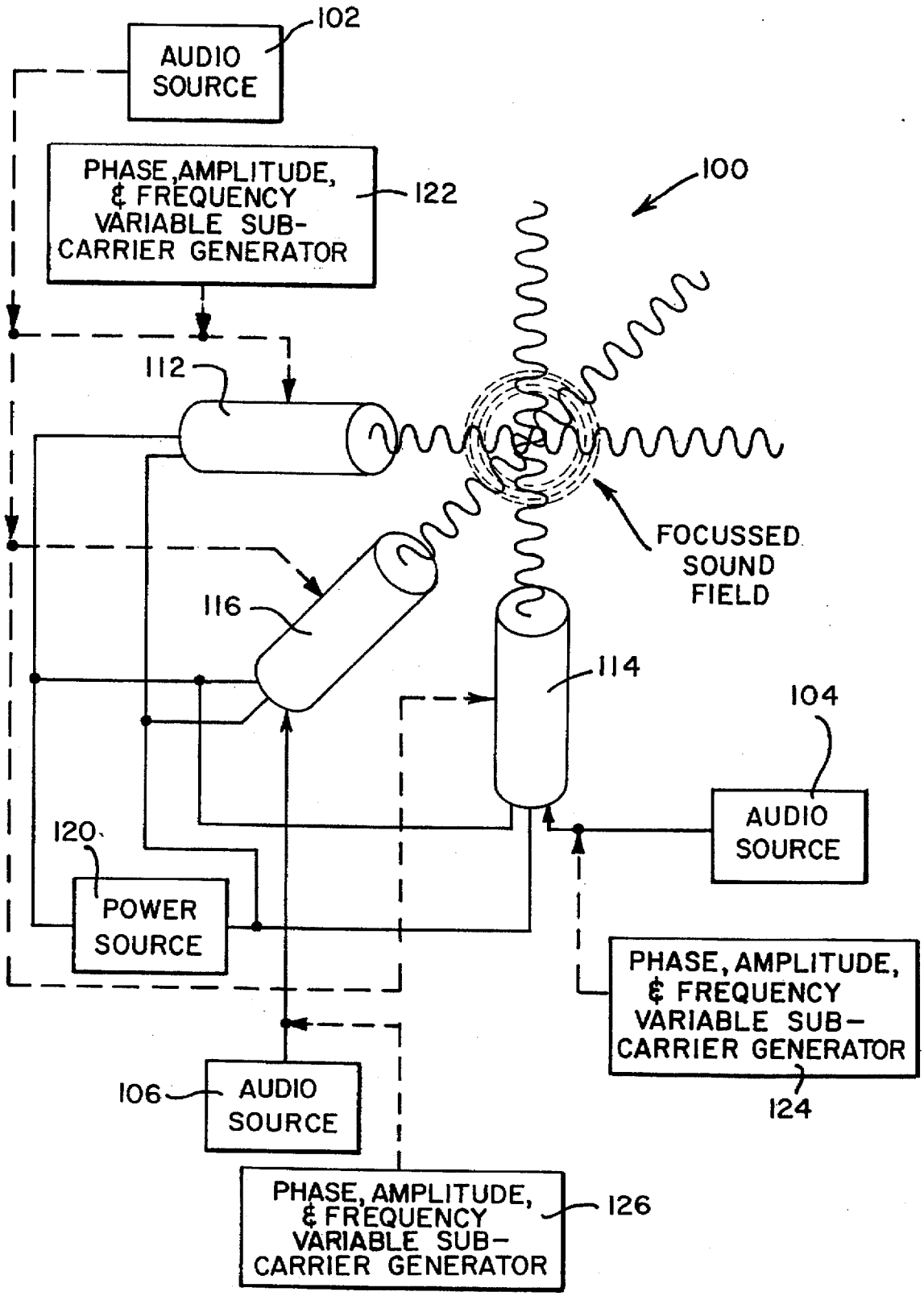
FIG. 1 is a block diagram of a three-dimensional sound generation apparatus according to the present invention.

According to the laws of thermodynamics, all energy can be reduced to forms of heat. Molecular, nuclear, chemical, electrical and acoustic energy can be quantified as a function of heat. At a temperature of zero Kelvin, all forms of energy cease because molecular, atomic and sub-atomic activity ceases. The human ability to detect light at different wavelengths as different colors occurs because the eyes have "target" cells which have evolved so as to detect energy in a given range of frequencies. The human eye cannot detect ultraviolet light or higher frequency energy, nor can it detect infrared radiation or lower frequency energy; however, energy at these frequencies does exist.

In the infrared region, light and heat are synonymous. The particles of energy radiated are photons. Since lasers typically emit coherent light, or light at a single frequency, lasers are particularly well suited for producing an extremely narrow beam of controlled, modulated infrared light. The laser is a photonic oscillator which takes electrical energy and converts it into light of one specific frequency or wavelength. It is a photonic device because it emits photons, as opposed to radio waves or gamma rays. It is an oscillator because there are electromagnetic waves of only one frequency or wavelength generated within the device, at a more or less constant or periodic rate. The single wavelength output of the laser is well suited for conveying information. Just as radio waves have embedded in them acoustic frequencies that can be converted back into sound, the laser output can be modulated by turning it on/off at varying rates to recreate particular frequencies, thereby producing sound. The laser output is modulated by mixing the optical or light waves with lower, variable frequencies, such as audio frequencies. Thus, the modulated laser output is analogous to a modulated carrier wave in radio. The outputs of multiple lasers may be combined in order to produce more intense heating/cooling.

If the laser is held stationary, the amount of heat imparted to the air will decrease with distance from the laser, i.e., as energy in the beam is transformed into heat, the beam gets weaker and less energy can be transmitted to the air located further away from the laser. If nothing is done, the laser will simply heat a line in space and no sound will be generated. To generate sound, the laser must be modulated or turned on and off at a rate that is within the audio band, e.g., DC to 20 KHz. This causes the air to heat and cool at a desired rate, thus producing a sound of a particular frequency. The heating and cooling creates pressure waves at the particular frequency which are equivalent to conventional sound waves. The sound produced by a single laser beam will be produced along the laser beam in a linear fashion and will decrease in amplitude as the distance from the laser increases. The volume of the sound will depend on the mount of energy in the laser beam. In effect the sound waves will be cone shaped with the large part of the cone at the laser output.

If two lasers are positioned orthogonal to each other, two orthogonal cones will be created which will interfere with each other where they intersect. If they have the same phase and frequency, they will add at the intersection producing increased sound. If they are 180 degrees out of phase, there will be cancellation at the intersection and no sound. If the frequencies are different, but both in an absorption frequency range, the resulting sound waves will be complex.

If the energy of any one laser is too low to produce significant sound, the addition of two or more beams at the intersection may be enough to create sound. A point source of sound can be created by having two or more laser beams intersect each other. There will be more sound at the intersection if the lasers are at the same frequency and phase, and the point of intersection is not too far from the lasers. Further, as the point of intersection is moved by repositioning the lasers, the apparent source of the sound will move in space. Naturally, the energy in each beam decreases with distance, so if the intersection is so far from each laser that the beam has already lost more than ⅔rds of its strength, the intersection of three beams will not be sufficient to produce more energy than one beam at its inception. Therefore, more laser beams may be needed to achieve the desired effect. Additionally, multiple laser beams may be aligned along the three axes of space to produce sound in each of the three dimensions, thus resulting in a generation of a volume of three dimensional sound.

The laser frequency may be set so that it is not readily absorbed by air, but is instead absorbed by a particular gas. The gas could then be confined in a chamber and radiated or energized by the laser beams. In this manner, the sound will be generated in the chamber. If the chamber were made like a hollow wall, this would cause the position of the sound to move by moving the laser beam over the chamber wall.

In the transmission of radio waves, a high frequency signal is mixed or modulated with a set of lower frequencies. Typically, microphones are used to convert mechanical energy (sound waves) into electrical energy which are then mixed with the higher frequency carrier wave. At the point of reception, a tuned circuit of electromagnetic devices designed to resonate at a specific frequency is used to detect and filter out the carrier wave, leaving the original electromagnetic impulses. At the receiver, the electromagnetic impulses are then converted back to acoustic or sound energy corresponding to the mechanical energy sound waves.

As indicated above, a modulated laser output signal may be used to generate sound. However, such a system is only operable in an atmosphere which is appropriate for the reception and absorption of infrared energy. There are two types of molecules appropriate for the reception of infrared light energy, while at the same time offering maximum energy transfer. These are water vapor and carbon dioxide (see FIGS. 3–6). FIGS. 3–6 represent the points within the infrared spectrum which have the greatest absorption of infrared energy at specific frequencies or wavelengths. Each Figure represents absorption at a specific pathlength, i.e., the maximum measured length or distance from the laser's physical boundaries, which here is 2 meters; an ambient temperature of 296 Kelvin; and an air pressure of one atmosphere. The charts shown in FIGS. 3–6 have been prepared using HITRAN-PC software available from the University of South Florida at Tampa Physics Department.

The conversion of light into sound occurs when specific molecules are resonated at specific frequencies. These specific frequencies are indicated as dips in the Figures at or below the 50% mark for transmission, i.e., the opposite of absorption. The deliberate and controlled injection of instantaneously variable amounts of heat into specific molecules (water vapor or carbon dioxide) will create instantaneously variable degrees of molecular motion or vibration. This can be analogized to billiard balls striking each other and transferring energy to adjacent balls. The vibration will occur at such a rate so as to create perceived instantaneous variations in local air densities, i.e., the compression and rarefaction of the air, which will be perceived as sound.

The laser's optical frequency is modulated by electromagnetic signals input via a microphone or other electrical audio source. The modulated carrier is produced at the laser output and is propagated into the atmosphere. The output variations which occur in the audio frequency range cause instantaneous variations in local air temperature at specific absorption points which in turn cause instantaneous variations in local air densities, resulting in local air compressions and rarefactions which produce sound waves.

The generation of sound waves, which are actually low-amplitude pressure waves, will require the laser to produce some variations in local air temperature from the mean ambient value. Additionally, the temperature variations established by the laser should be as small as 50 μseconds to produce audio signals up to 20 kHz, i.e., the range of human detection of sound. For example, the establishment of a particular sound wave requiring that the temperature of a 1 cc target zone be increased by 1 degree Kelvin within a 1 μsecond time interval requires heat Q in the amount of:

$$Q=c_v m\Delta T \quad (1)$$

where Q represents the heat energy transferred, $c_v$ is the constant-volume specific heat for air, m is the air mass, and ΔT is the temperature change in degrees Kelvin. Substituting the appropriate values for air gives:

$$Q=0.716 kJ/(kg\cdot K)\times(1.29\times10^{-6})$$

$$Q=0.924\times10^{-6}\ kJ/cc \text{ of air}$$

Thus, the power required to raise the temperature of the 1 cc target zone by 1 degree Kelvin in 1 μsecond is equivalent to:

$$\text{Power}=0.924\times10^{-6}\ kJ/10^{-6}\ \text{sec}=0.924\ kW \text{ or } 924 \text{ Watts}$$

These power requirements are well within the capabilities of currently available lasers. Accordingly, heating and cooling of air in times on the order of 1 μsecond, i.e., up to 1 MHz operation, may be achieved to produce sounds up to 20 kHz and beyond using conventional lasers.

The sound waves will be produced in areas or zones where there are significant targets available to absorb the laser energy. These target zones are areas of significant laser energy absorption, such as greater than 50% absorption. The absorption in the target zones occurs for more than a single frequency of the incident radiation. The target zones thus have an effective bandwidth of frequencies at which significant absorption takes place. This use of lasers rum counter to the traditional use of lasers in communication systems which seek to minimize the absorption of the laser energy. Essentially, photothermoacoustics relies on the traditional obstacles to laser transmission to achieve its desired effect and function.

The modulated laser output may be brought into direct contact with other modulated outputs to produce complex, multidimensional waveforms. The combination of these multiple outputs may be used to produce either constructive or destructive interference of the resultant combined waveform. In this way, sonic holography, i.e., the three dimensional visual recording and reproduction of sonic events is possible. Sonic holography relies on the interactions of waves of varying geometries on three mutually orthogonal axes to produce a constantly changing three dimensional sound. In addition to the generation of three dimensional sound, localization of the sound is also possible by deliberately altering one or more of the sound components along the three axes to thereby locationally shift the generation of the sound.

Sound localization may be accomplished by including additional information in the system signals. For example, a sub-carrier of known frequency, amplitude and phase may be utilized to convey localization information. The localization information may be input via a user controlled joystick whose spatial movements are converted into corresponding laser positioning signals to cause the laser beams from the multiple sources to intersect at different positions and heat the air at the intersection, thereby spatially locating the generated sound at the variable intersection. In this way, sound may be dynamically localized to a precise location—something which is not possible at all with conventional fixed location planar speakers.

Referring now to FIG. 1, therein is illustrated a three dimensional sound generation apparatus 100 according to one embodiment of the present invention. Sound generation apparatus 100 includes audio sources 102, 104 and 106 for driving the x, y and z axes, respectively. Alternatively, a single audio source, such as 102, may be used to drive all three axes. Sound generation apparatus 100 also includes lasers 112, 114 and 116 for the x, y and z axes, respectively. Lasers 112, 114 and 116 are powered by power supply 120. Localization of the outputs of lasers 112, 114 and 116 in the x, y and z directions is provided by phase, amplitude and frequency variable sub-carrier generators 122, 124 and 126, respectively, which may also include mechanical positioning devices to aim the lasers in different directions to change the position of the source of the sound. The outputs of lasers 112, 114 and 116 may optionally be provided with lenses (not shown) for directing their respective outputs.

Figure 2A:
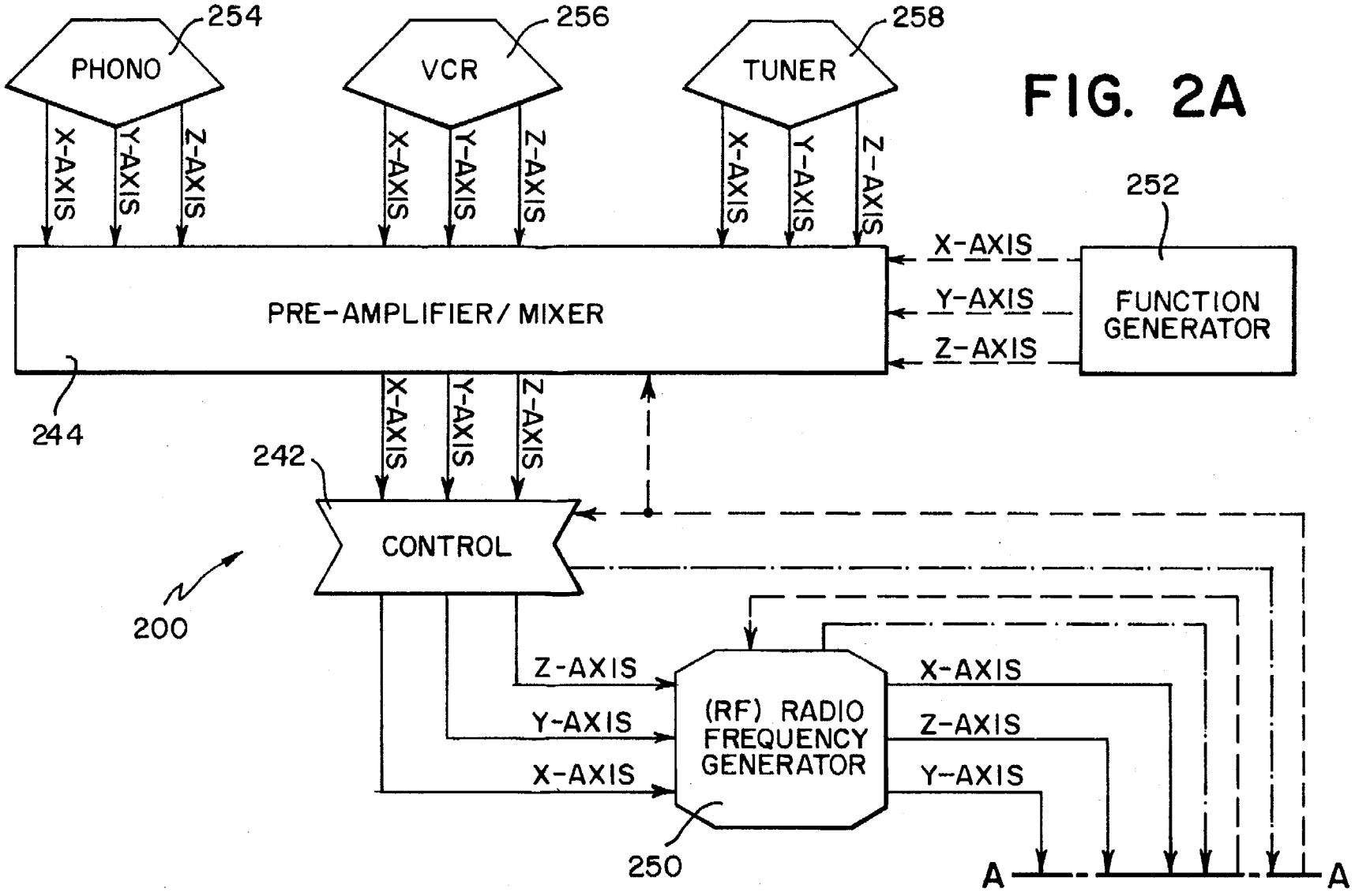
FIGS. 2A and 2B is a block diagram of an alternative embodiment of a three-dimensional sound generation apparatus according to the present invention.
Figure 2B:
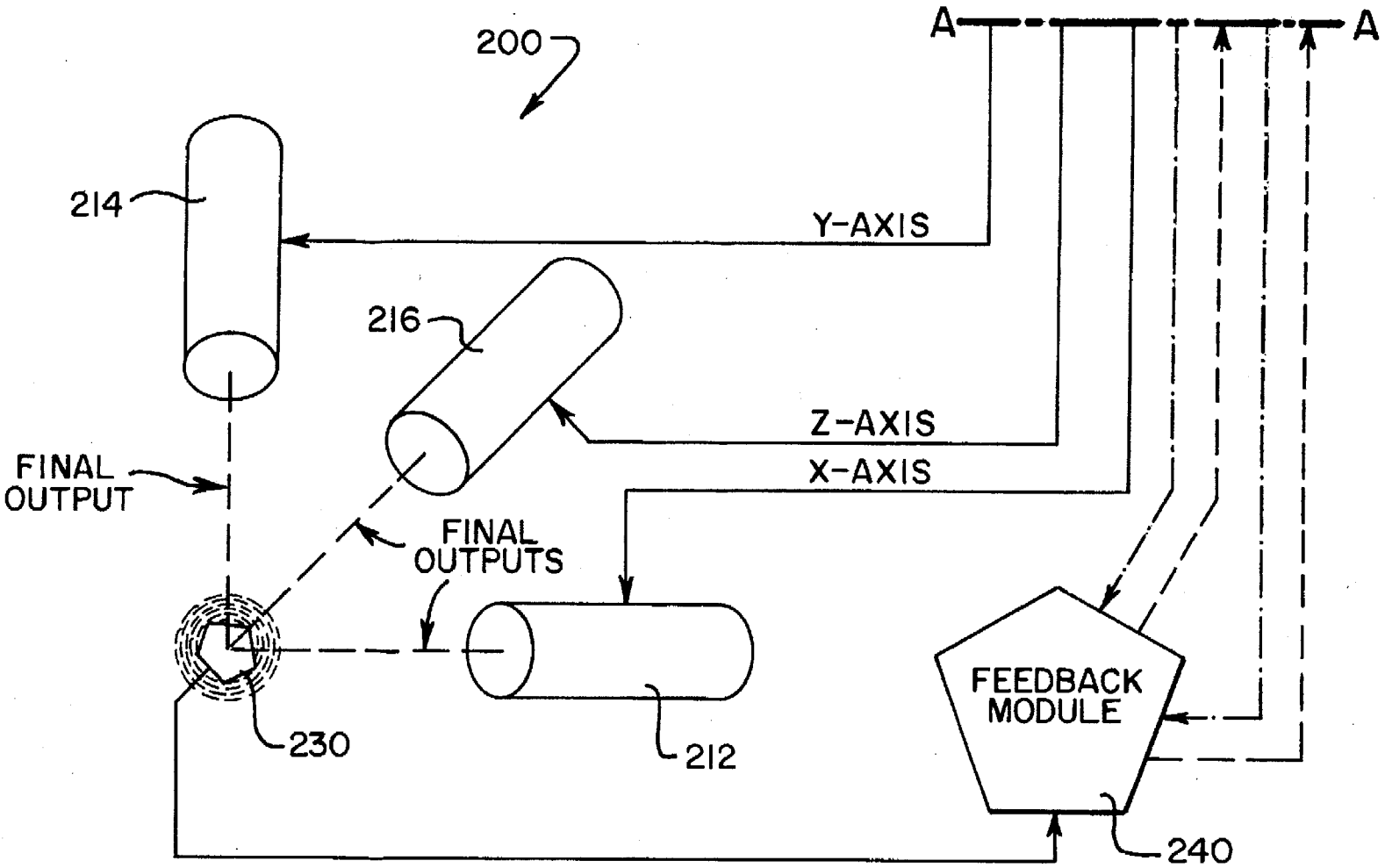
Figure 3:
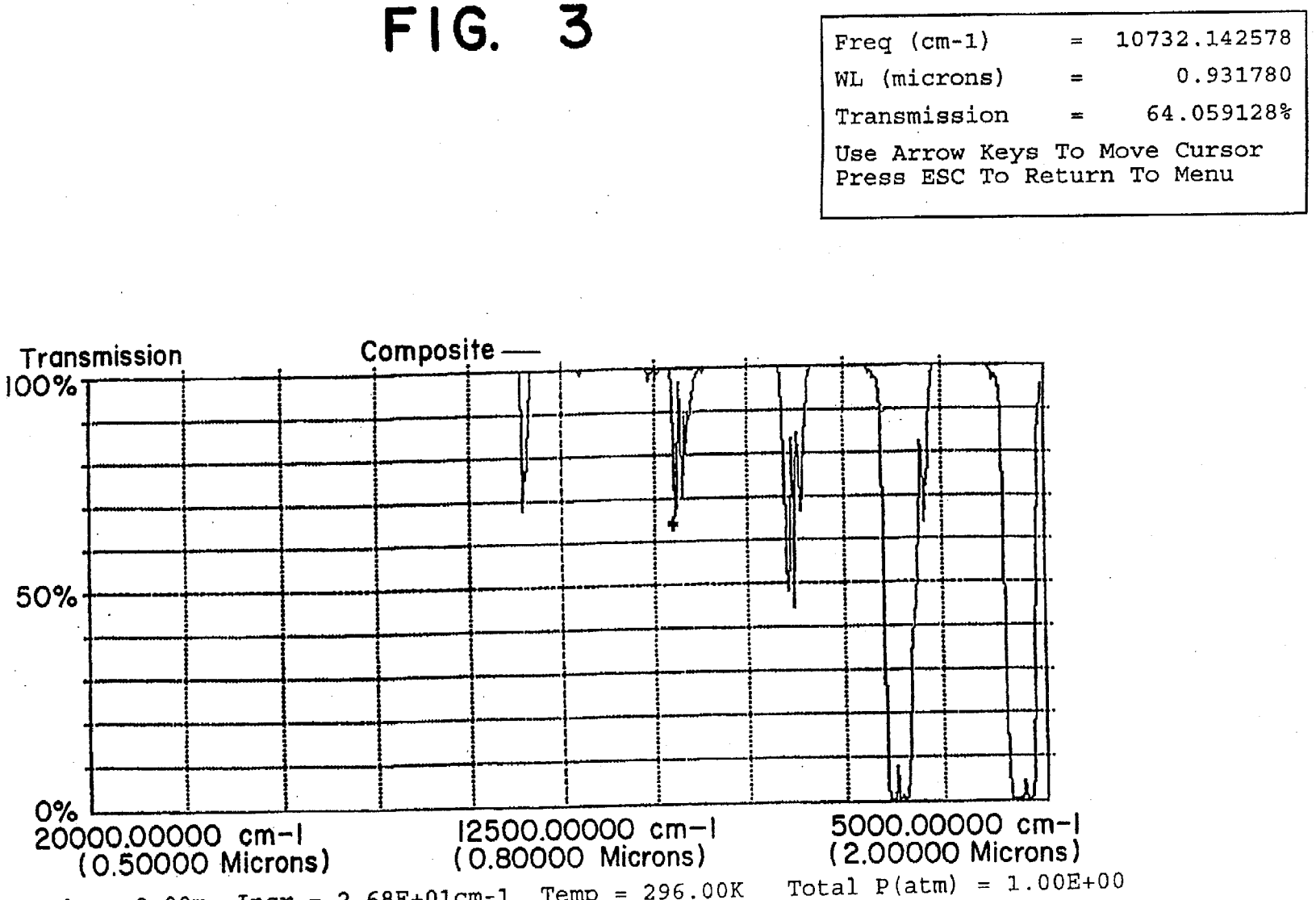
FIG. 3 is a transmission graph showing energy transmission efficiency in the range of 0.5 to 2.0 microns.
Figure 4:
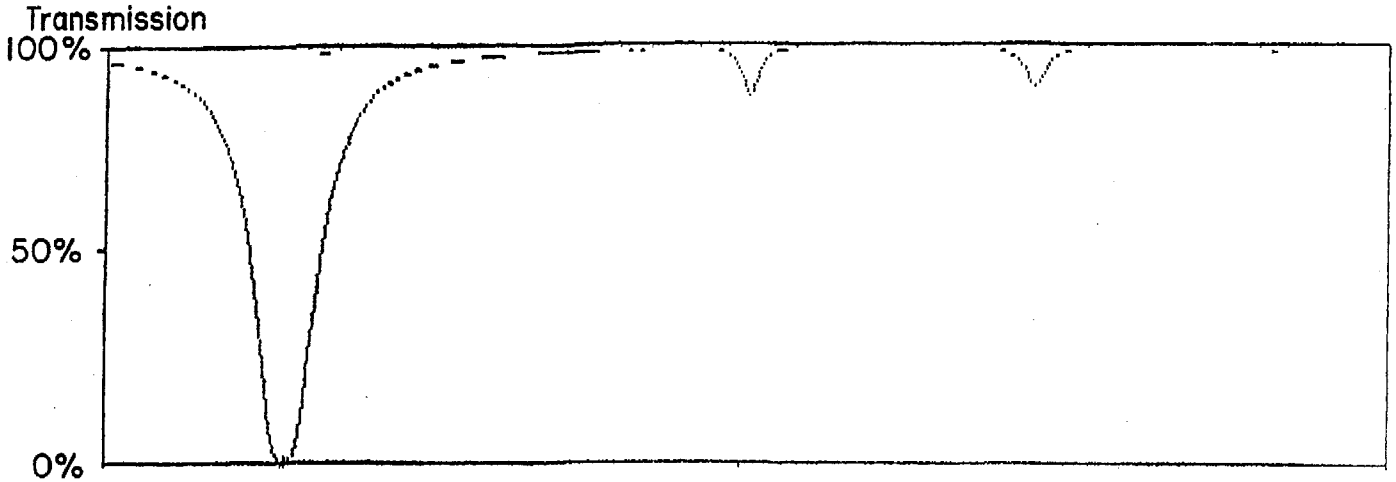
FIG. 4 is a transmission graph showing energy transmission efficiency in the range of 500 to 1000 microns.
Figure 6:
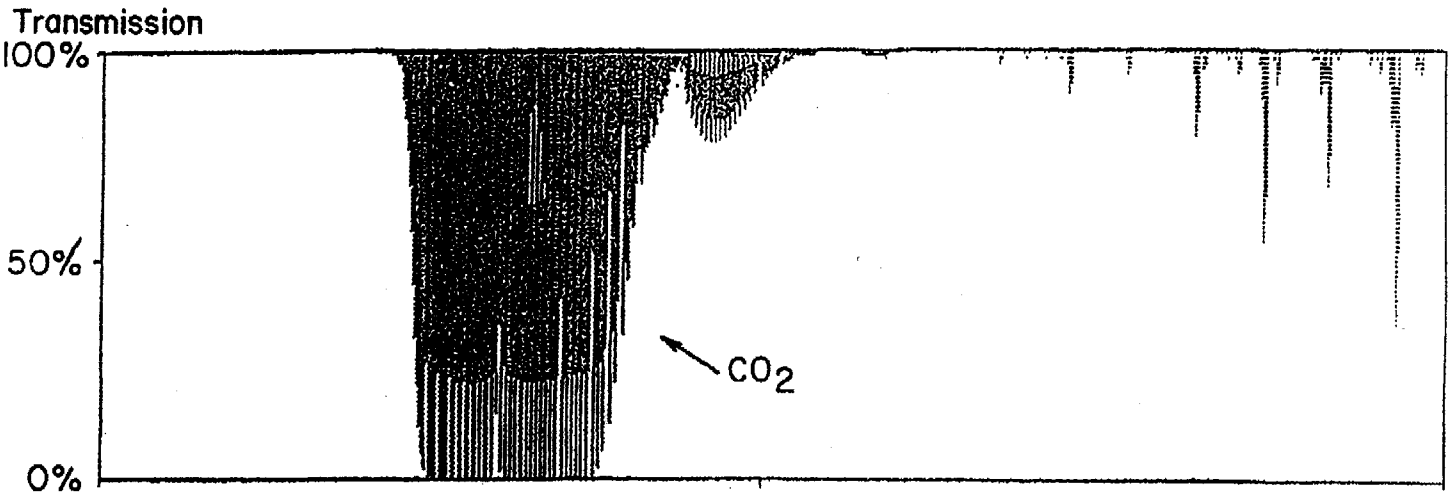
FIG. 6 is a transmission graph showing energy transmission efficiency in the range of 4 to 5 microns.

The sound generation apparatus according to the present invention may be modified to include a feedback system to dynamically and instantaneously adjust the operation of the apparatus in response to air currents, humidity and altitude changes, and user/operator preferences. In the case of photothermoacoustic applications, the feedback system is designed to be capable of fast frequency response and typically utilizes infrared sensors. Such a system is illustrated in FIGS. 2A and 2B. The photothermoacoustic sound generation device 200 illustrated in FIGS. 2A and 2B is similar to the apparatus 100 shown in FIG. 1. Accordingly, only the major differences between the two systems are labelled in FIGS. 2A and 2B and discussed herein.

Referring now to FIGS. 2A and 2B, therein is shown a three dimensional sound generation apparatus including a sensor 230 for monitoring the focused sound field output of the x, y and z axis lasers. Sensor 230 may be a microphone or other sensor capable of detecting the focused sound field. Alternatively, it may be an infrared detector that picks up the infrared energy focused at the sensor by the lasers, which energy is related to the heat, and thus, the sound generated at the sensor.

The output of sensor 230 is input to feedback module 240 which provides appropriate control signals to control module 242. Control module 242 is used to adjust the input audio signal, e.g., from function generator 252, phono 254, VCR 256, tuner 258, or any other appropriate audio input source. RF generator 250 is used to generate the radio frequency carrier signal which is then modulated by the signals from function generator 252. Control module 242 controls the amount of audio and/or function generator 252 signals injected into the system; control the phase, frequency and amplitude of each of the subcarriers from the RF generator; and facilitate the size and location of the sound field. It should be noted that the output signal from sensor 230 is a three channel composite signal conveying information about the x, y and z axes. Also, feedback module 240 is connected directly to RF generator 250. Feedback module 240 is also connected to preamplifier/mixer 244 in order to correct any detected audio frequency drift.

According to an alternative embodiment, the present invention may be used to controllably heat and cool a gas to thereby provide mechanical energy or force. The controlled heating and cooling of the gas may be used to establish standing waves. These standing waves may be static and stationary, in that despite ongoing propagation of sound, there exists in a given space close to the source, molecular pressure zones created by the regular peaks and valleys of the standing wave. The standing waves may thus be used as sound barriers or even physical barriers. In the case of a physical barrier, the standing wave is created with sufficient energy to counteract the opposing mechanical force. In this manner, photothermoacoustic levitation may be achieved by creating a counteracting force equal and opposite to the gravitational force acting on a body. Similarly, if the standing wave is created with sufficient energy greater than the opposing mechanical force, then photothermoacoustic propulsion or motion may be achieved. For example, once the gravitational and frictional forces are negated, propulsive force may be applied in order to set and maintain an object in motion.

The magnitude of the levitation force may be calculated using certain applicable laws of thermodynamics. The gas in which an object is to be levitated or propelled according to the present invention may be a gas, such as air. At ambient conditions, air is known to behave in a manner characteristic of an ideal gas, the concept of which greatly simplifies the prediction of gas behavior over broad ranges of temperature and pressure.

Ideal gas theory is based upon certain assumptions about the physical nature of a gas, including: (1) that the molecules which make up the gas are identical and in a stable state; (2) the molecules may be modeled as hard spheres which obey Newton's laws of motion; (3) the total number of molecules is large, with the resulting large number of intermolecular collisions maintaining the overall distribution of molecular velocities and the randomness of the motion; (4) the volume of the molecules is a negligibly small fraction of the total volume occupied by the gas, a plausible assumption given the fact that gas volumes may be changed through a large range of values with little difficulty, and that when a gas condenses the volume occupied by the liquid may be thousands of times smaller than that occupied by the gas; (5) no appreciable forces act on the molecules except during a collision; and that (6) intermolecular collisions and collisions with the walls of any container are completely elastic, thereby conserving molecular momentum and kinetic energy.

Using these basic assumptions of ideal gas theory, the following equation can be derived, which relates gas pressure P, gas density p, and the molecular root-mean-square speed or average molecular speed $V_{rms}$:

$$P=\tfrac{1}{3}\rho V^2_{rms} \tag{2}$$

Since the average molecular speed is not a readily measurable macroscopic quantity, additional thermodynamic equations are required to readily solve for the pressure P. One such equation is the following expression for RMS particle velocity in an ideal gas:

$$V_{rms}=\sqrt{(3kT/m)} \tag{3}$$

where the Boltzmann constant $k=1.38\times10^{-23}$ J/molecule·K, T is the absolute temperature in Kelvin, and m is the mass of a single molecule in kilograms.

The internal energy U of an ideal gas is also related to temperature according to the following relationship:

$$U=\tfrac{3}{2}NkT \tag{4}$$

where k is the Boltzmann constant identified above, U is the internal energy of the gas in Joules, N is the number of gas molecules, and T is the temperature in Kelvin.

Combining the above expressions for $V_{rms}$ and U (Eqs. 3 and 4) yields:

$$V_{rms}=\sqrt{(2U/mN)} \tag{5}$$

Combining $P=\tfrac{1}{3}\rho V^2_{rms}$ (Eq. 2) and $V_{rms}=\sqrt{(2\ U/mN)}$ (Eq. 5), the resulting equation is:

$$P=\tfrac{2}{3}(\rho U/mN) \tag{6}$$

However, since the gas density $\rho=(Nm/V)$, where N is the number of molecules, m is the mass per molecule, and V is the volume occupied by the gas, the following equation relating pressure P, internal energy U, and gas volume V can be formulated:

$$P=\tfrac{2}{3}(U/V) \tag{7}$$

Equation 7 is useful in that it yields the energy requirements for any desired pressure increase. As an example of the use of Equation 7, assume that it is desired to increase the pressure of 1 cubic millimeter of air from one atmosphere to five atmospheres. Solving the equation for internal energy U, and using $P_i$ and $P_f$ to represent the initial and final pressures, respectively, the energy required for this pressure increase may be calculated as follows:

$$\Delta U=\tfrac{3}{2}(P_f-P_i)V=\tfrac{3}{2}[(5-1)\times10^5\ \text{pascals}]\cdot[1\times10^{-9}\ m^3]\ \text{or}\ \Delta U=0.6\ \text{milliJoules/cubic millimeter}$$

With absorption spectra in multiple bands approaching 100%, the addition of the above amount of energy should produce the desired pressure increase.

The levitation of objects which may vary widely in mass, and hence weight, requires the application of a pressure of sufficient magnitude. The desired pressure should be sufficient to allow the object to be lifted off the ground without resulting in an excessive and uncontrolled vertical acceleration. Determination of the required pressure may be accomplished by performing a force balance on a disk-shaped volume which, for illustrative purposes, will serve as an example of an object to be levitated. The relevant characteristics of the disk are its volume V, circular face area A, thickness t, and mass density $\rho_m$. The pressure which gives rise to the net force on the lower surface of the object shall be designated as $P_{net}$. The derivation of an expression for the required levitation pressure $P_{net}$ begins with the following equation relating disk mass and density. Specifically, the mass is equivalent to the product of mass density, $\rho_m$ and volume, V or tA:

$$m=\rho_m V=\rho_m tA \tag{8}$$

To accomplish levitation, the net vertical force exerted by the pressurized air under the object must be greater than the object's weight in order to overcome the gravitational force acting on the object. The relationship between these forces may be expressed mathematically as follows, incorporating the definition of pressure as force per unit area, or P=F/A, and taking into account that weight is equal to the product of mass and the local acceleration due to gravity:

$$P_{net}A>mg \tag{9}$$

Incorporating Equation 8 yields:

$$P_{net}A>\rho_m tAg \tag{10}$$

or by canceling area:

$$P_{net}>\rho_m tg \tag{11}$$

where g=9.81 m/sec$^2$ is the local acceleration due to gravity. The result is an expression for the minimum pressure required to levitate an object of a given mass density and thickness, independent of surface area. The required pressure is independent of surface area since the same pressure must be applied to the entire surface regardless of its area. For example, if the disk is 0.01 meters thick, has a circular face area of 0.1 m$^2$, and is made of stainless steel having a mass density of $\rho_m$=8,000 kg/m$^3$, then according to Equation 11, the net pressure is:

$$P_{net}>(8\times10^3\ kg/m^3)(0.01\ m)(9.81\ m/sec^2)$$

$$P_{net}>7.85\times10^2\ \text{Pascals}(N/m^2)$$

In the earlier example discussed above, it was determined that an energy input of approximately 0.6 mJ/mm$^3$ would produce a $P_{net}$ of $4\times10^5$ Pascals, or more than five hundred times that required to lift the object.

Energy requirements for levitation, in contrast to pressure requirements, are dictated by the lower surface area of the object. The relationship between surface area and required energy input may be derived by considering the amount of work done in lifting an object to a particular height. The most general definition of mechanical work, which allows for variation in both force and direction of travel, may be expressed mathematically in vector notation as follows:

$$W_{AB}=\int_A^B \vec{F}\cdot d\vec{r} \tag{12}$$

This equation yields a value for the amount of work $W_{AB}$ done by a force F while moving an object along a displacement vector r from point A to point B. In the present invention, the relevant displacement for calculating the work done in lifting an object is the vertical displacement, designated as y. Since the levitation force is also aligned vertically, the vector Equation 12 simplifies to the following scalar equation, with the levitation force F expressed as a function of vertical displacement y:

$$W_{AB}=\int_A^B F(y)\,dy \tag{13}$$

The levitation force F(y) is equal to the product of the net pressure under the object, $P_{net}$, and the object's circular face area A, which is constant. The limits of integration are y=0, representing the object at rest on the ground, and y=h, which will represent its final levitation height. Making the appropriate substitutions into Equation 13, and using $W_{lev}$ to denote the work done in levitating the object, yields:

$$W_{lev}=\int_0^h P_{net}(y)A\,dy \tag{14}$$

Since area A is constant, Equation 14 becomes:

$$W_{lev}=A\int_0^h P_{net}(y)A\,dy \tag{15}$$

Equation 15 shows that the work performed, and hence the energy required, to levitate an object is directly proportional to its lower surface area.

Figure 7:
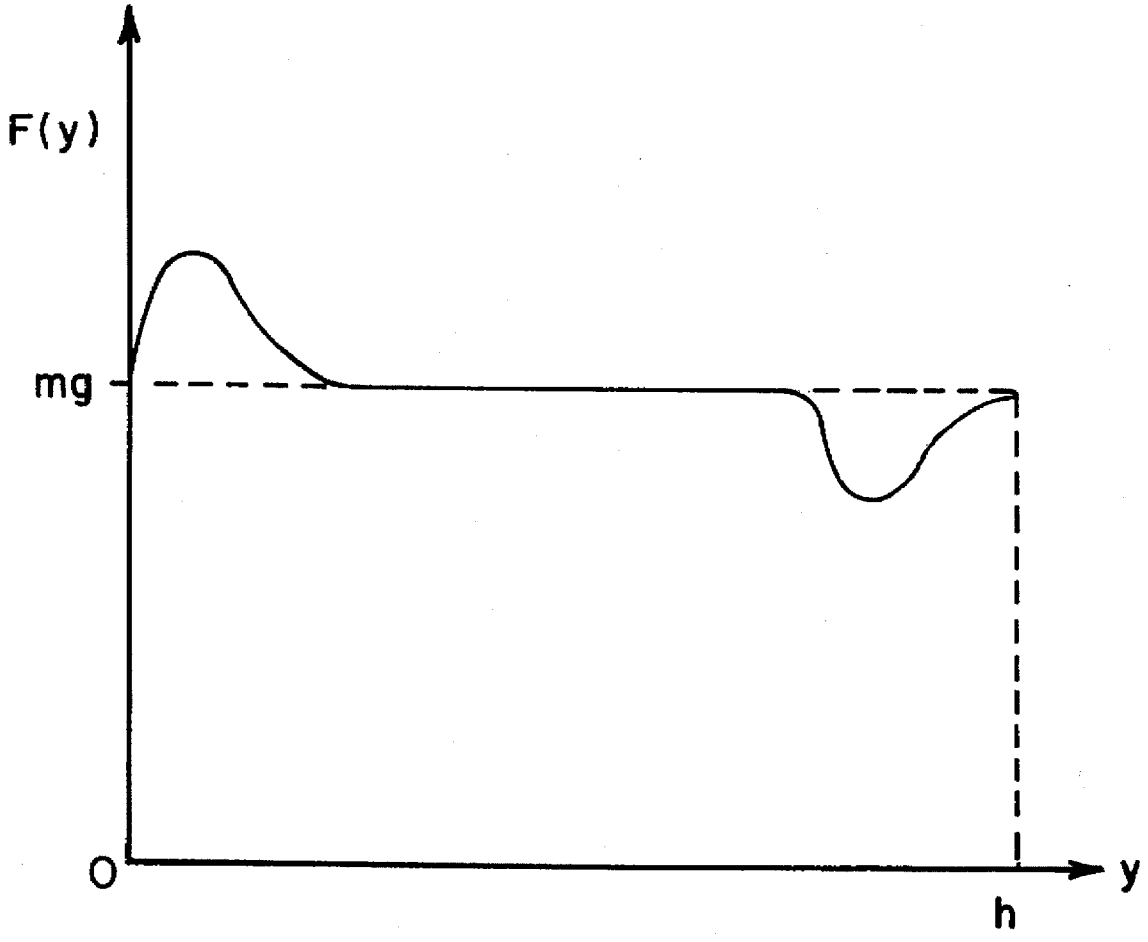
FIG. 7 is a force-displacement graph showing force requirements for levitation as a function of height.

The process of levitating an object from the ground to assume some desired equilibrium (motionless and unaccelerated) height h will require that the levitation force $F(y)=P_{net}(y)A$ vary in magnitude from a value slightly above the object's weight to a value slightly below the object's weight, before settling at a magnitude equal to the object's weight when height y=h has been achieved. A plot of the desired variation of levitation force as a function of vertical displacement is shown in FIG. 7. The force-displacement curve of FIG. 7 should provide slight accelerations and, hence, the desired level of control during the process of levitation. The initial increase in the levitation force F(y) is required to lift the object off the ground, after which F(y) settles to a value equal to the object's weight to ensure a constant velocity during the process of levitation. Shortly before reaching the desired height h, the levitation force is decreased to a value slightly below the object's weight in order to decelerate the object to zero velocity. At y=h, the object hovers motionless in a condition of equilibrium between weight and levitation force.

Continuing with the example discussed above, assume a disk volume of 0.001 m$^3$ and an average levitation force equal to the object's weight (a reasonable approximation based on the above discussion). Using $\eta$ to denote the working efficiency of the device, the energy required to levitate the stainless steel disk to a height of 2 meters, assuming $\eta$=0.5, is as follows:

$$E_{lev} = \frac{W_{lev}}{\eta} = \frac{1}{\eta} \int_0^h P_{net}(y)\, dy = \frac{\rho_m t A g h}{\eta} \quad (16)$$

Substitution into Equation 16 results in:

$$E_{lev} = (1/0.5)(8000\ kg/m^3)(0.01\ m)(0.1\ m^2)(9.81\ m/sec^2)(2\ m)$$

$$E_{lev} = 3.139 \times 10^2\ J \text{ or } 313.9\ J$$

The assumed working efficiency of the device is 50%. Given an energy input of 313.9 J, the device will levitate the 8 kg stainless steel disk to a height of 2 meters. The volume of air which is heated under the object to be levitated corresponds in shape to the surface area of the object times a height of up to approximately 500 millimeters.

A sound barrier may be created in accordance with the present invention by surrounding a noise source with high pressure zones which sufficiently impede the propagation of sound waves emanating from the sound source.

While the invention has been particularly shown and described with reference to a preferred embodiment thereof, it will be understood by those skilled in the an that various changes in form and details may be made therein without departing from the spirit and scope of the invention.

I claim:

1. A photothermal acoustic device comprising:

A first laser energy source emitting infrared energy in a first dimension at a first frequency that will be absorbed by a target gas in order to produce pressure density variations in said target gas;

a second laser energy source emitting infrared energy in a second dimension at a second frequency that will be absorbed by the target gas in order to produce pressure density variations in said target gas, said second dimension being orthogonal to said first dimension;

a first signal source connected to the first laser energy source for modulating the infrared energy emitted by the first laser energy source in accordance with the first signal source; and a second signal source connected to the second laser energy source for modulating the infrared energy emitted by the second laser energy source in accordance with the second signal source.

2. A photothermal acoustic device according to claim 1, wherein the target gas includes at least one of air and carbon dioxide.

3. A photothermal acoustic device according to claim 1, further comprising:

a third laser energy source emitting infrared energy in a third dimension at a frequency that will be absorbed by the target gas in order to produce pressure density variations in said target gas, said third dimension being orthogonal to said first and second dimensions; and a third signal source connected to the third laser energy source for modulating the infrared energy emitted by the third laser energy source in accordance with the third signal source; wherein said pressure density variations created by the laser energy sources create three dimensional sound waves.

4. A photothermal acoustic device according to claim 3, wherein the pressure density variations produced by the first, second and third laser energy sources form a sound isolation barrier.

5. A photothermal acoustic device according to claim 3, wherein the pressure density variations produced by the first, second and third laser energy sources form a mechanical propulsion force.

6. A photothermal acoustic device according to claim 3, wherein the frequencies of the first second and third laser energy sources are the same, the phases of the first, second and third laser energy sources are the same and the emitted energies of the first, second and third laser energy sources intersect.

7. A photothermal acoustic device according to claim 6, further comprising:

control means for spatially positioning the three dimensional sound waves.

8. A photothermal acoustic device according to claim 6, further comprising:

a feedback system including at lease one sensor for sensing the three dimensional sound waves and a control circuit for adjusting the infrared energy emitted by the first, second and third laser energy sources according to the sensed three dimensional sound waves.

* * * * *